US005472172A

United States Patent [19]

Sell

[11] Patent Number: 5,472,172

[45] Date of Patent: Dec. 5, 1995

[54] LEVER STOP FOR A LEVER OPERATED HOIST

[75] Inventor: Leslie J. Sell, Bothell, Wash.

[73] Assignee: Ingersoll-Rand Company, Woodcliff Lake, N.J.

[21] Appl. No.: 334,972

[22] Filed: Nov. 7, 1994

Related U.S. Application Data

[63] Continuation of Ser. No. 38,439, Mar. 29, 1993, abandoned.

[51] Int. Cl.[6] ..... B66D 1/14

[52] U.S. Cl. ..... 254/352; 74/526

[58] Field of Search ..... 254/209, 217, 254/352, 353, 354; 74/526

[56] References Cited

U.S. PATENT DOCUMENTS

| | | | |
|---|---|---|---|
| 912,717 | 2/1909 | Murphy | 74/526 |
| 1,537,695 | 5/1925 | Riley | 74/526 |
| 2,546,289 | 3/1951 | Adduci | 74/526 |
| 2,863,330 | 2/1958 | Moorhead | 74/526 |
| 3,049,938 | 8/1962 | Hulten et al. | 74/526 |
| 4,471,946 | 9/1984 | Maeda | 254/353 |

*Primary Examiner*—Katherine Matecki
*Attorney, Agent, or Firm*—Walter C. Vliet

[57] ABSTRACT

A lever rotation limiting device which permits lever orientation anywhere within the full arc of rotation plus an additional degree of rotation to permit effective operating range as, for example, in a lever operated hoist.

7 Claims, 1 Drawing Sheet

LEVER STOP FOR A LEVER OPERATED HOIST

This application is continuation of application Ser. No. 08/038,439, filed Mar. 29, 1993 now abandoned.

BACKGROUND OF THE INVENTION

This invention relates generally to devices for limiting the rotation of a lever or the like and more particularly to a device which permits orientation of a reciprocating lever crank for a hoist while preventing unlimited rotation of the handle relative to the hoist.

In a prior design it was possible to place the selector knob in the unlocked position to permit rapid deployment of the chain and at the same time place the selector lever on the handle to the up ratchet position and turn the handle in a number of complete turns in the up direction to lift the load. Since the brake was held off in this case, the only thing that prevented the load from dropping and the handle from flying around the process was the person holding on to the handle. This, of course, is an undesirable result.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a lever stop for a lever operated hoist comprising a stop ring mounted for rotation about a common axis of rotation of an operating lever of a hoist proximate the lever and the hoist; a first stop means for permitting limited rotation of the lever relative to the stop ring; and a second stop means for permitting limited rotation of the stop ring relative to the hoist, the first stop means and the second stop means together permitting unlimited positioning of the lever about its axis of rotation while preventing unlimited lever rotation.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
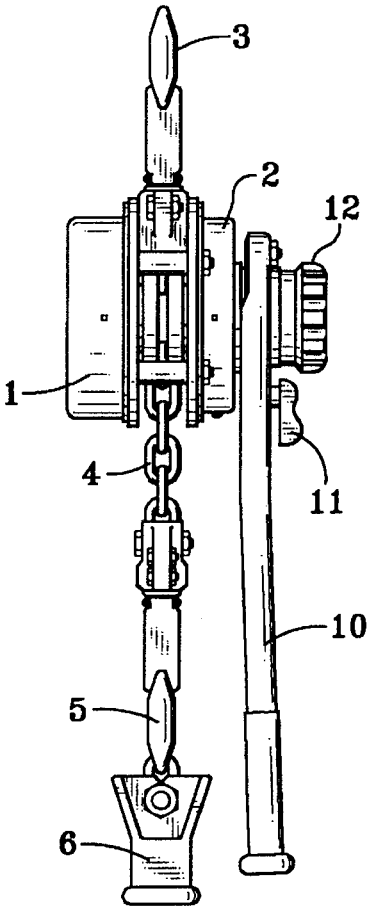
FIG. 1 (PRIOR ART)
FIG. 1 is a side view of a lever operated chain hoist according to the prior art.

Referring to FIG. 1, a lever operated chain hoist 1 according to the prior art is shown. According to the prior art, the hoist handle 10 is reciprocated in ratcheting fashion selected by lever ratchet reverse selector 11 to alternatively raise or lower the load. A well-known braking function prevents the lowering of the load except by the reciprocating action of the lever. In one known embodiment of the prior art, a function selector knob 12 is provided to select a free spool action which permits the rapid deployment of the chain 4 from an unloaded hoist. The chain is prevented from escaping the hoist body 2 by means of a chain stop 6. In general, such hoists are suspended by means of a support hook 3 and are provided with a load hook 5 to engage the lifted load.

Figure 2:
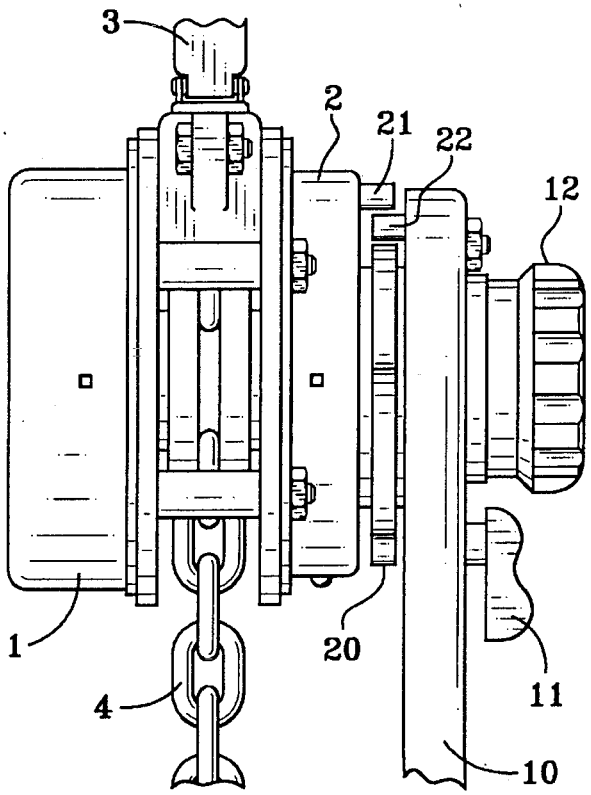
FIG. 2 shows a modification of the chain hoist according to the present invention in the side view.

As previously indicated in the prior art, it was possible to place the selector knob in the unlocked (free spool) position, then put the selector lever on the handle to the up position and turn the handle any number of complete rotations (for example, clockwise to lift the load). Unfortunately, having disabled the brake, this permitted the load to drop and the handle to fly around in the process if the person within the load released the handle. For this reason, as shown in FIG. 2, a simple device called a stop ring 20 is added. A stop pin or boss 21 is attached to the hoist housing 2 in a radially outward position from the center of rotation of the handle lever shaft and a lever stop or boss 22 is placed on the handle in a radially inward position from the housing boss 21.

Figure 3:
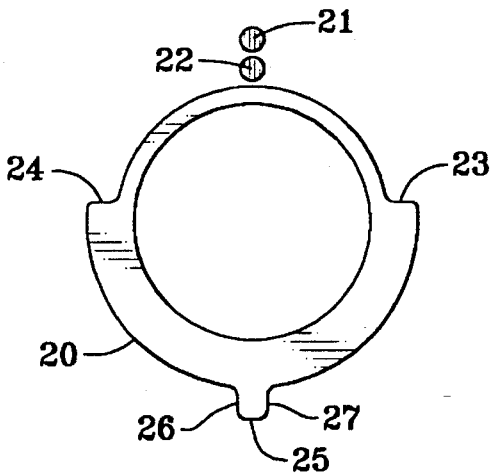
FIG. 3 shows the end view in elevation of a stop ring in relationship to the hoist body stop and the lever stop according to the present invention.

As shown in FIG. 3, a stop ring according to the present invention is shown as viewed from the right hand side to the left in FIG. 2.

Figure 4:
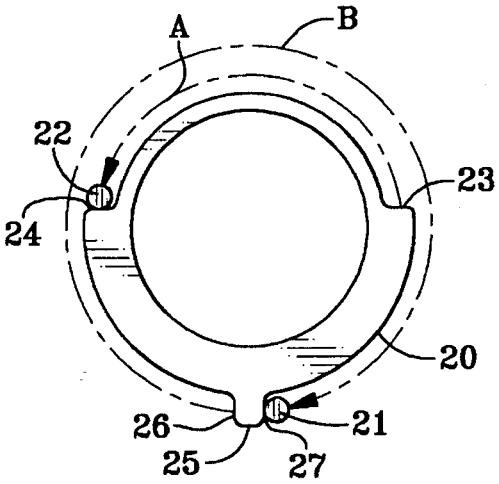
FIG. 4 is an end view of the stop ring showing the permitted degree of rotation.

The stop ring is provided with a reduced circumferential width to form a counterclockwise land 24 and a clockwise land 23. The lands 23 and 24 coact with the lever stop 22 (at the relative radially inward position on the lever) upon rotation of the lever. For example, upon counterclockwise rotation of the lever, the lever stop 22 will contact counterclockwise land 24 and conversely upon clockwise rotation of the lever, the lever stop 22 will contact the clockwise land 23. This permits the lever to rotate through an arc designated A in FIG. 4 before contacting the ring. The permitted rotation provided is typically in the order of 160 degrees, but may be readily increased to any desired arc up to about 350 degrees. In addition, the stop ring 20 is provided with a boss 25 extending radially outward from the ring. The boss 25 is provided with a clockwise abutment 26 and a counterclockwise abutment 27 which cooperates with the body stop 21 at a radially outward position to permit and limit the rotation of the stop ring to approximately 350 degrees. The amount of permitted rotation can be varied by increasing the width of the boss 25. This permits the lever to rotate through an arc, designated B in FIG. 4, before contacting the ring. The total possible rotation of the lever before the stop ring limits rotation is therefore the sum of arc A and arc B. In the present case (FIG. 4) this is approximately 505 degrees.

One of the obvious fixes for the prior art problem of limiting lever rotation would be to put a stop pin on the body of the hoist which would interfere directly with the lever. This, however, restricts the use of the hoist which in operation may need to be positioned anywhere in a 360 degree handle position and thereafter ratcheted through an additional arc to operate the hoist from all the possible positions.

In operation summary, in the present invention, the stop ring is located on the bearing boss between the handle and the hoist body and restricts rotation of the handle to slightly less than one and one-half turns in either direction. The stop ring is free to rotate around the handle bearing boss approximately 345 degrees until the tab or boss 25 contacts the body stop end 21 on the hoist body. The handle is free to rotate relative to the stop ring approximately 160 degrees until the lever stop pin 22 on the handle contacts the stepped shoulder on the stop ring at either land 24 in counterclockwise rotation or clockwise land 23 in clockwise rotation. Being radially inward, the lever stop 22 on the handle is able to rotate past the body stop 21 on the body.

The combined rotation of the handle described above relative to the stop ring and the stop ring relative to the body is approximately 505 degrees. Therefore, in normal operation of the hoist from any angle, the presence of the stop ring is not apparent to the operator. However, in abnormal (free spool) operation, as described above, should the handle be released with a load it will rotate at a maximum 505 degrees before being stopped by the stop ring/stop combination. This present invention will also prevent runaway of the load in the unlikely event of brake malfunction.

As may be appreciated by one skilled in the art the stop shoulders on the stop ring may be extended more or less to achieve any angle up to about approximately two turns as previously described. The rings could also be stacked to achieve even greater rotation angles, if desired.

What is claimed is:

1. A lever stop for a lever operated hoist comprising:

a stop ring mounted for rotation about a common axis of rotation of a reciprocating operating lever of a hoist intermediate said lever and said hoist;

said stop ring being provided with a first stop surface and a second stop surface;

a first stop means on said lever for coacting with said first stop surface for permitting limited rotation of said lever relative to said stop ring; and a second stop means on said hoist for coacting with said second stop surface for permitting limited rotation of said stop ring relative to said hoist, said first stop means and said second stop means together permitting unlimited positioning of said lever about its axis of rotation while preventing unlimited lever rotation.

2. A lever stop for a lever operated hoist according to claim 1, wherein said stop ring and said lever are mounted for rotation about a common shaft.

3. A lever stop for a lever operated hoist according to claim 1, wherein said Stop ring is provided with a plurality of said first stop surfaces which radial project from said stop ring for cooperation with said first stop means in alternative directions of rotation.

4. A lever stop for a lever operated hoist according to claim 1, wherein said stop ring is provided with a plurality of said second stop surfaces Which radially project from said stop ring for cooperation with said second stop means in alternative directions of rotation.

5. A lever stop for a lever operated hoist according to claim 1, wherein said first stop surface is positioned radially inward of said second stop surface on said ring, and said first stop means is positioned radially inward of said second stop means to permit circumferential passage of said first stop means and said second stop means upon rotation of said lever.

6. A lever stop for a lever operated hoist according to claim 6, wherein said stop provided with diameter reducing stops and a diameter increasing boss.

7. A lever stop for a lever operated hoist according to claim 6, wherein said stop ring is provided with a central bore for rotational mounting on a shaft common with said lever, and said shaft is rotatably mounted within said hoist body.

* * * * *